United States Patent [19]

Ozaki

[11] Patent Number: 4,659,316

[45] Date of Patent: Apr. 21, 1987

[54] SHIP WITH PROPELLER SHAFT PARTITION RINGS

[76] Inventor: Hideji Ozaki, 568, Kojima, Tomie-Cho, Minamimatsuura-Gun, Nagasaki Pref., Japan

[21] Appl. No.: 813,936

[22] Filed: Dec. 26, 1985

[30] Foreign Application Priority Data

Dec. 31, 1984 [JP] Japan ..... 59-202077
Mar. 28, 1985 [JP] Japan ..... 60-46509

[51] Int. Cl.[4] ..... B63H 23/34

[52] U.S. Cl. ..... 440/83; 440/112; 114/162

[58] Field of Search ..... 114/149, 152, 57, 162, 114/165; 440/49, 51, 83, 111, 112; 308/DIG. 12; 277/58, 81 R, 216

[56] References Cited

U.S. PATENT DOCUMENTS

| | | | |
|---|---|---|---|
| 386,991 | 7/1888 | Lamburth | 114/162 |
| 1,559,660 | 11/1925 | Ward | 114/57 |
| 2,167,552 | 7/1939 | Paine | 114/162 |
| 3,540,405 | 11/1970 | Clay | 440/112 |
| 3,934,952 | 1/1976 | Gardner | 440/112 |
| 4,395,141 | 7/1983 | Pietsch et al. | 440/112 |

FOREIGN PATENT DOCUMENTS

| | | | |
|---|---|---|---|
| 92072 | 10/1983 | European Pat. Off. | 440/112 |
| 33288 | 3/1977 | Japan | 114/162 |
| 477849 | 8/1975 | U.S.S.R. | 440/112 |

*Primary Examiner*—Galen Barefoot
*Assistant Examiner*—Stephen P. Avila
*Attorney, Agent, or Firm*—Young & Thompson

[57] ABSTRACT

A ship includes a rudder and a propeller having a propeller shaft arranged adjacent a stern of the ship. A bottom of stern is made shallow to expose the propeller for a long distance and the rudder is arranged in a space defined by the bottom of the stern, the propeller shaft and a propeller post supporting the propeller shaft, thereby arranging the rudder nearer to a bow of the ship than the propeller. The propeller shaft comprises oil-water partition rings encircling the propeller shaft, and a bearing for the propeller shaft is formed with circular grooves which accommodate therein the oil-water partition rings and communicate with at least one oil-water separating pressurizing tank to form a water exhausting passage on an outer side of each the partition ring and an oil exhausting passage on an inner side of the partition ring.

5 Claims, 9 Drawing Figures

SHIP WITH PROPELLER SHAFT PARTITION RINGS

BACKGROUND OF THE INVENTION

This invention relates to a power driven boat or ship capable of decreasing friction with water and more particularly to a boat or ship having a rudder arranged at a particular location and having a novel propeller bearing.

The term "ship" as used herein is intended to designate a boat or ship which comprises a propeller and is driven by power.

FIG. 1 illustrates a conventional ship 1 having a propeller 2 and a rudder 3 behind the propeller. Reference numeral 4 denotes a waterline.

As can be seen from FIG. 1, the rudder 3 is located behind the propeller 2. When the ship is cruising on the water, water flow driven by rotation of the propeller moves faster than other water relative to the ship. The difference in velocity between the water flow driven by the propeller and other water becomes greater as the cruising speed of the ship increases. Under such a condition, it is very disadvantageous to arrange the rudder behind the propeller at a location that the water flows at the maximum speed, as shown in FIG. 1, because the rudder is subjected to the maximum friction of water.

In conventional small ships such as fishing boats, bearings for propeller shafts are generally made of white metal or copper alloys which are lubricated by sea water rather than lubricating oil. Propeller shafts of large ships are fitted thereon with copper alloy sleeves to prevent rust and journaled in bearings made of lignumvitae (hard wood produced in the tropics) with lubrication of sea water. However, the sea water tends to enter the bearings of the propeller shafts. It is important to prevent the entrance of the sea water and to recover the lubricant completely without escaping into the sea.

SUMMARY OF THE INVENTION

It is a primary object of the invention to provide an improved ship which decreases friction with water, thereby increasing cruising speed with the same power and decreasing pitching and rolling and which has power of resistance to large waves.

In order to achieve this object, in a ship including a rudder and a propeller having a propeller shaft arranged adjacent a stern of the ship, according to the invention, the rudder is arranged nearer to a bow of the ship than the propeller.

In a preferred embodiment of the invention, a bottom of a stern of the ship is made shallow to expose the propeller for a long distance and the rudder is arranged in a space defined by the bottom of the stern, the propeller shaft and a propeller post supporting the propeller shaft.

A rudder rod is connected to a substantially intermediate portion of the rudder to form a balanced rudder.

It is another object of the invention to provide a ship capable of decreasing friction and wearing of a bearing for a propeller shaft to prevent vibration of the ship and to increase mechanical efficiency.

In order to achieve this object, according to the invention, the propeller shaft comprises oil-water partition rings encircling the propeller shaft, and a bearing for the propeller shaft is formed with circular grooves which accommodate therein the oil-water partition rings and communicate with at least one oil-water separating pressurizing tank to form a water exhausting passage on an outer side of each partition ring and an oil exhausting passage on an inner side of the partition ring.

In a preferred embodiment of the invention, the oil-water separating pressurizing tank comprises a peep window, an oil-water valve, an oil retracting valve and a sea water exhausting valve.

In another embodiment, a closing ring is provided to seal the water exhausting passage adjacent to the propeller shaft, the closing ring being divided into plural split rings and moved and fixed by solenoid valves whose coils and operating pistons are enclosed by waterproofing bellows, and hooks for the respective split rings are provided on an outer wall of the water exhausting passage to prevent vibration of the split rings.

In order that the invention may be more clearly understood, preferred embodiments will be described, by way of example, with reference to the accompanying drawings.

DESCRIPTION OF THE PREFERRED EMBODIMENT

Figure 1:
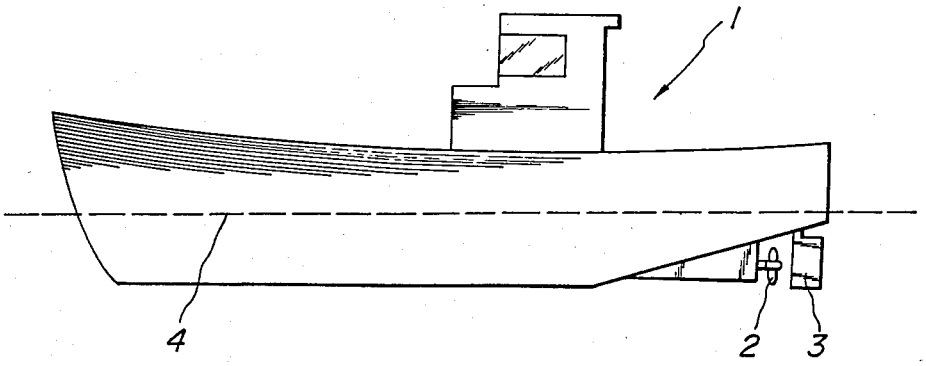
FIG. 1 PRIOR ART
FIG. 1 illustrates a conventional ship.
Figure 2:
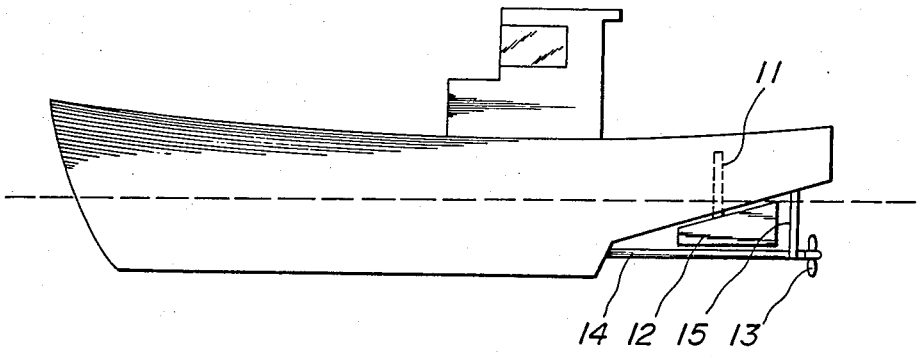
FIG. 2 illustrates a ship according to the invention.

FIG. 2 illustrates a ship to which is applied a preferred embodiment of the invention. Diesel engines have be used for fishing boats and ships of plastics have been widely used. As the result, shapes of ships have been changed. Particularly, shapes in the proximity of propellers have been greatly changed. In the present invention, a stern of the ship is greatly changed. According to the invention, a bottom of the stern is made shallow to expose a propeller shaft 14 of a propeller 13 for a long distance in order to increase the water to be supplied to the propeller 13 for the purpose of increasing speed of the ship. Within a space defined by the bottom of the stern, the propeller shaft 14 and a propeller post 15 supporting the propeller shaft 14, is arranged a rudder 12 having a rudder rod 11. In this manner, the rudder 12 is arranged nearer to a bow of the ship than the propeller 13 according to the invention.

Figure 3:
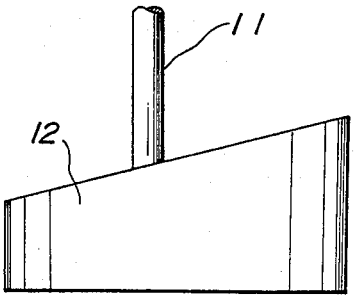
FIG. 3 is a view of a rudder used in the ship shown in FIG. 2.
Figure 4:
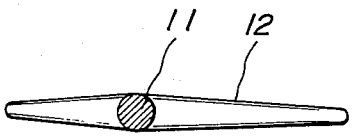
FIG. 4 is a plan view of the rudder shown in FIG. 3.

With this arrangement, the rudder 12 is not subjected to the friction of water flow flowing at high speeds, so that the ship can cruise faster with the same power supplied to the propeller. As the rudder is located near to the center of the ship, pitching and rolling decrease and there is less chance of exposing the bottom of the ship above the water surface. Accordingly, the ship according to the invention has power of resistance to large waves and the rudder works well. Owing to the longitudinally long length of the rudder and the positional relation of the rudder to the ship, the straight cruising of the ship can be maintained for long time. As the rudder is provided substantially at an intermediate portion with the rudder rod to form a balanced rudder as shown in FIGS. 3 and 4, it is easily operated.

Figure 5:
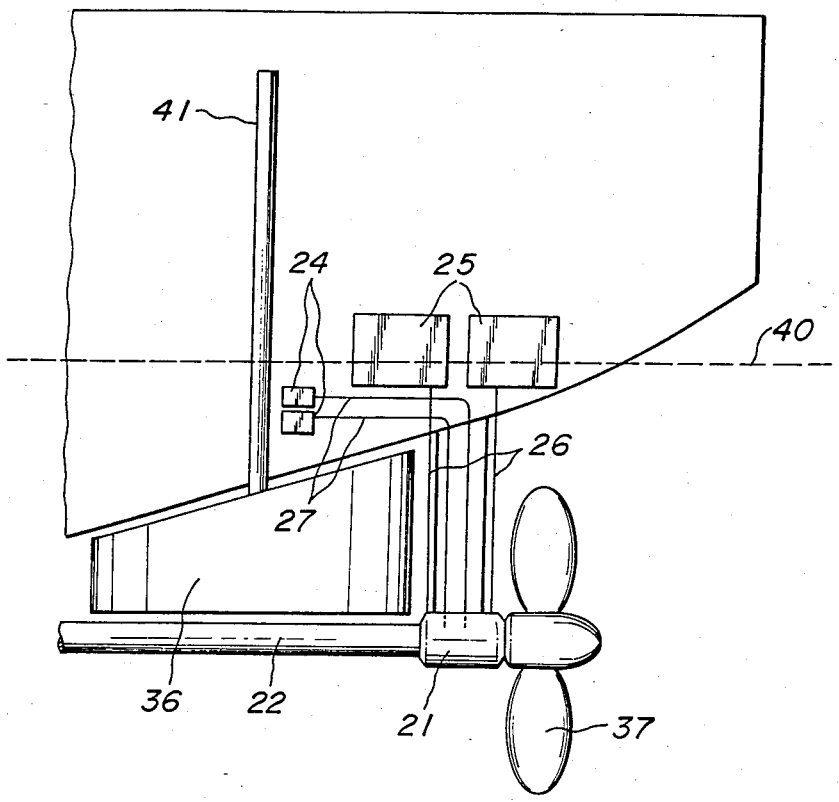
FIG. 5 illustrates a stern of a ship of another embodiment of the invention.

FIG. 5 illustrates a further embodiment of the invention, wherein a ship comprises a rudder 36 having a rudder rod 41 and further comprises a particular bearing 21 for a propeller shaft 22 of a propeller 37, which comprises oil supply means 24 and an oil-water separating pressurizing tank 25. Reference numeral 40 denotes a waterline.

Figure 6:
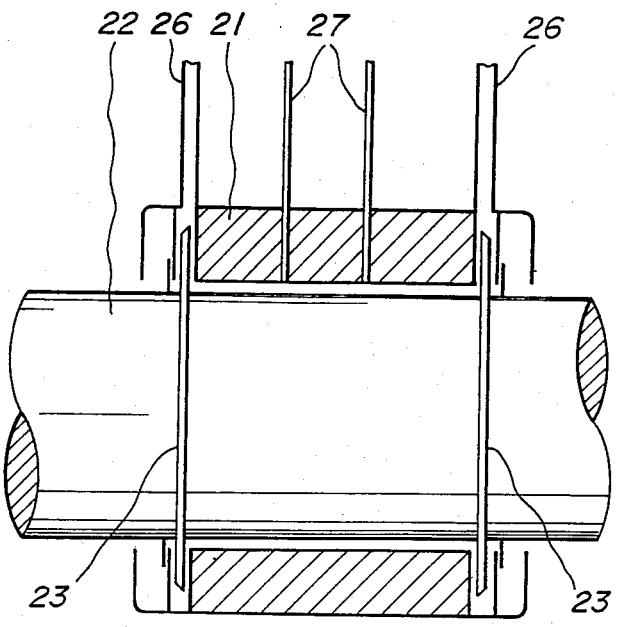
FIG. 6 is a partial sectional view of a bearing of the propeller shaft shown in FIG. 5.

Referring to FIG. 6, the bearing 21 comprises two oil supply pipes 27 and two used oil exhaust pipes 26. The propeller shaft 22 includes two oil-water partition rings or oil slingers 23 encircling the propeller shaft 22.

Figure 7:
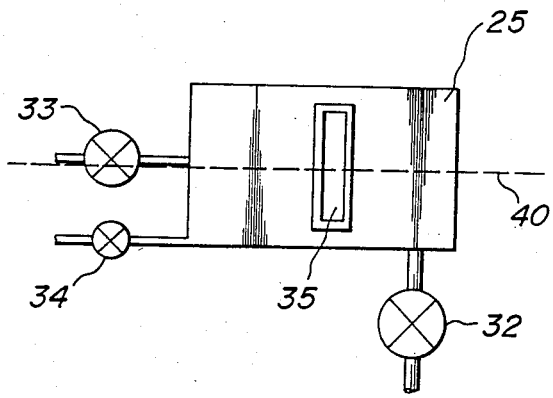
FIG. 7 is a view of an oil-water separating tank used in the embodiment shown in FIG. 5.

Referring to FIG. 7 illustrating the oil-water separating pressurizing tank 25 including a peep window 35, an oil-water valve 32, an oil extracting valve 33 and a sea water exhausting valve 34. The sea water exhausting valve 34 and the oil extracting valve 33 are operated to produce a certain pressure in the tank 25, thereby preventing the sea water from entering the bearing to an excess extent.

Figure 8:
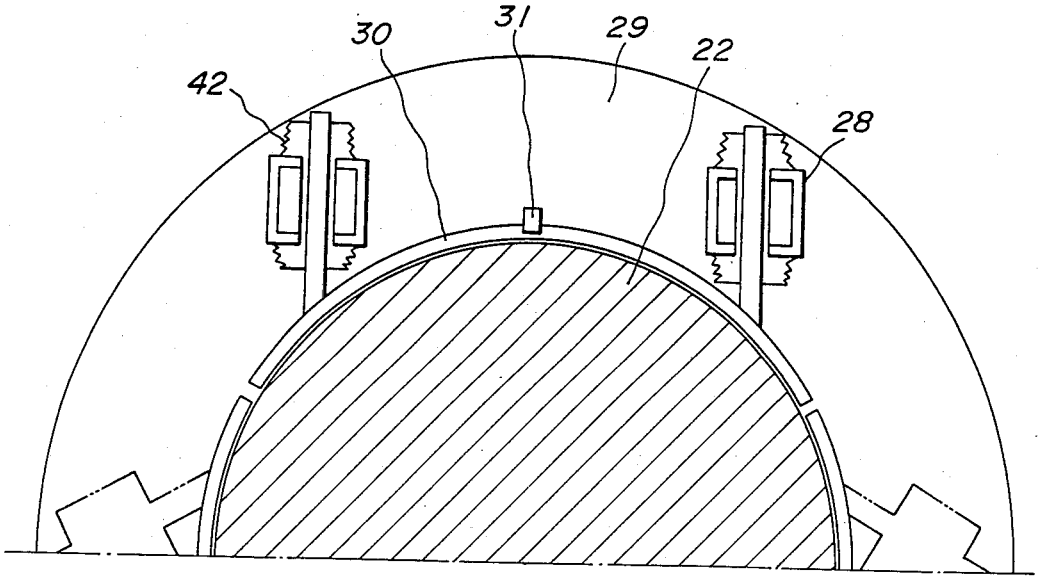
FIG. 8 illustrates split rings and solenoid valves for moving the same used in the embodiment shown in FIG. 5.
Figure 9:
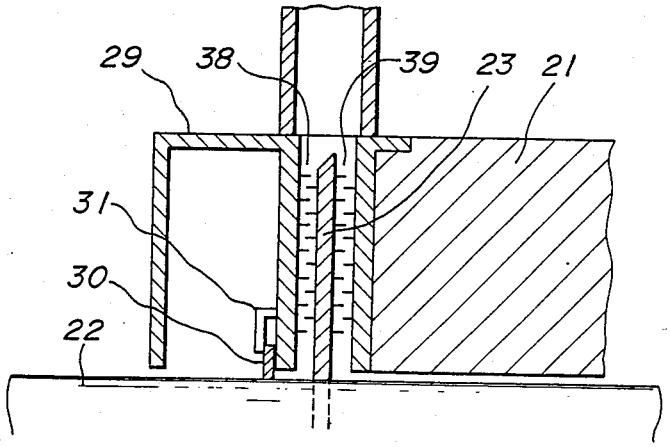
FIG. 9 is a sectional view illustrating part of the bearing in detail shown in FIG. 6.

Referring to FIG. 8, the bearing 21 is designed so as to be separable into upper and lower parts for adjusting the clearance between the bearing and the propeller shaft 22 and for repairing and inspection of the bearing and propeller shaft. A closing ring is divided into three split rings 30. The three split rings 39 of the closing ring are moved by six solenoids 28 whose coils and operating pistons are enclosed by waterproofing bellows 42 and fixed to bearing housing cover 29 of the bearing 21. Hooks 31 serve to prevent vibration of the split rings 30. In FIG. 9, reference numerals 38 and 39 denote a water exhausting passage and an oil exhausting passage respectively formed on outer the respectively and inner sides of the partition ring 23.

With this arrangement, the water and oil are urged outwardly along the oil-water partition rings 23 by centrifugal force when the propeller is rotating. A number of oil-water partition rings 23 and a corresponding number of grooves in the bearing are provided to form a number of S-shaped passages for the oil and water. When the oil and water are subjected to the centrifugal force, the oil is restrained from flowing due to its viscosity and water is easily urged outwardly. Moreover, the oil is heated in the bearing owing to the rotation of the propeller shaft to decrease the specific gravity of the oil, so that the oil becomes much lighter than the water. Accordingly, only the oil enters the oil-water separating tank 25. The pressure of the oil supply means 24 prevents the sea water from entering the oil-water separating tank 25.

When the propeller shaft is stopped during anchoring, the sea water tends to enter the bearing due to difference in specific gravity between the sea water and the oil. In order to prevent this, the solenoids 28 are actuated to enclose the propeller shaft by the split rings 30 to close the bearing housing.

This embodiment decreases the wearing of the bearing to prevent vibration of a ship and decreases friction at the bearing to increase mechanical efficiency. Moreover, according to this embodiment, the propeller shaft is exposed for a long distance beneath out of the ship to increase the water to be supplied to the propeller so as to increase the propelling efficiency.

It is further understood by those skilled in the art that the foregoing description is that of preferred embodiments of the disclosed ships and that various changes and modifications may be made in the invention without departing from the spirit and scope thereof.

What is claimed is:

1. A ship including a rudder and a propeller having a propeller shaft arranged adjacent a stern of the ship, wherein said propeller shaft comprises oil-water partition rings encircling the propeller shaft, and a bearing for the propeller shaft is formed with circular grooves which accommodate therein said oil-water partition rings and communicate with at least one oil-water separating pressurizing tank to form a water exhausting passage on an outer side of each said partition ring and an oil exhausting passage on an inner side of the partition ring.

2. A ship as set forth in claim 1, said oil-water partition rings extending radially outwardly of said shaft and terminating in free edges that are disposed within and spaced from the side walls of said circular grooves, whereby both said sides of each said partition ring communicate with the same said tank.

3. A ship as set forth in claim 1, wherein said oil-water separating pressurizing tank comprises a peep window, an oil-water valve, an oil retracting valve and a sea water exhausting valve.

4. A ship as set forth in claim 1, wherein a closing ring is provided to seal the water exhausting passage adjacent to the propeller shaft, said closing ring being divided into plural split rings and moved and fixed by solenoid valves whose coils and operating pistons are enclosed by waterproofing bellows.

5. A ship as set forth in claim 1, wherein hooks for respective split rings are provided on an outer wall of said water exhausting passage to prevent vibration of said split rings.

* * * * *